US005755677A

United States Patent [19]

Masuda et al.

[11] Patent Number: 5,755,677

[45] Date of Patent: May 26, 1998

[54] MASSAGING APPARATUS HAVING MASSAGE ROLLERS ROTATABLY MOUNTED ON TRAVELING UNIT

[75] Inventors: Teruo Masuda, Tokyo; Shoji Ohshita, Saitama-ken; Fumihiro Yoshidome, Machida, all of Japan

[73] Assignee: France Bed Co., Ltd., Tokyo, Japan

[21] Appl. No.: 612,885

[22] PCT Filed: Apr. 14, 1995

[86] PCT No.: PCT/JP95/00727

§ 371 Date: Mar. 4, 1996

§ 102(e) Date: Mar. 4, 1996

[87] PCT Pub. No.: WO96/01610

PCT Pub. Date: Jan. 25, 1996

[30] Foreign Application Priority Data

Jul. 12, 1994 [JP] Japan ..... 6-160223
Jul. 12, 1994 [JP] Japan ..... 6-160224

[51] Int. Cl.[6] ..... A61H 15/00

[52] U.S. Cl. ..... 601/99; 601/102; 601/103; 601/116; 601/126

[58] Field of Search ..... 601/98, 99, 101–103, 601/115–116, 122, 126.8

[56] References Cited

U.S. PATENT DOCUMENTS 3,405,709 10/1968 Mathers .
3,687,133 8/1972 Grubelic .
3,736,920 6/1973 Mathers et al. ..... 601/116 X
4,149,531 4/1979 Tanaka et al. ..... 601/116 X
4,586,493 5/1986 Goodman ..... 601/116
4,662,362 5/1987 Masuda .
4,718,408 1/1988 Barreiro ..... 601/99

FOREIGN PATENT DOCUMENTS 1283532 12/1961 France .
1283532 5/1962 France .

*Primary Examiner*—Danton D. DeMille
*Attorney, Agent, or Firm*—Frishauf, Holtz, Goodman, Langer & Chick

[57] ABSTRACT

A guide unit (4) is held by a holding unit (1) in a predetermined state and has a guide section (4*e*). A travelling unit (21*a*, 21*b*) is so mounted on the guide section (4*e*) as to be freely run. The travelling unit (21*a*, 21*b*) is driven, by a drive unit (10), in reciprocatory motion along the guide section (4*e*). Roller supports (35) are mounted on the travelling unit (21*a*, 21*b*) and massage rollers (53) are mounted on the roller support (35) such that their rotation center lies in a direction intersecting with a run direction of the travelling unit (21*a*, 21*b*). At least one of the roller support (35) and massage roller (53) is rotatably mounted on the travelling unit (21*a*, 21*b*).

13 Claims, 10 Drawing Sheets

MASSAGING APPARATUS HAVING MASSAGE ROLLERS ROTATABLY MOUNTED ON TRAVELING UNIT

BACKGROUND OF THE INVENTION

1. Field of the Invention

The present invention relates to a massaging apparatus for applying a massaging action to a user through a reciprocating drive of massage rollers.

2. Description of the Related Art

In general, this type of massaging apparatus includes a base covered at its open upper side with a cover and holders equipped with massage rollers and capable of freely running, and is adapted to impart a massaging action to the user in bed in a supine position by reciprocably running the holders by a drive means.

The massaging apparatus has a mattress type and a chair type and, usually, the former type includes two holders provided at a given interval in a running direction in a spaced-apart relation and the latter type includes one holder capable of freely running.

In either case, in order to enhance a massaging effect, a plurality of massage rollers are rotatably supported at given intervals in a spaced-apart relation in a width direction at least intersecting with the run direction of the holder. These massage rollers are run while pushing against both the sides of the backbone and legs of the user.

The massage rollers run along the uneven surfaces of the backbone and legs of the user, but such uneven surfaces are curved in the user's particular width direction and in a height direction. The area from the waist to buttocks is greater in the degree of curving than the rest of the body and, when such a curved area is massaged by massage rollers which are simply rotatable on the holders, only some of the massage rollers abut against the "back" surface of the user and the remaining massage rollers are sometimes hardly pressed against that surface.

Since, therefore, the massage rollers are not firmly abutted under a given pressure force against, for example, a narrow portion of the waist, recesses are formed at both the sides of the backbone and curved portion of the legs, no adequate massage effect is obtained and, in addition, projected areas are sometimes too strongly struck by some massage rollers and the user sometimes feels pain.

Still further, with such a massaging apparatus wherein the massaging action is applied to the user through the reciprocatory motion of the massage rollers over a base, the massaging effect is enhanced by more massage rollers. In the conventional massaging apparatus, however, one massage roller is provided on one reciprocably driven massage holder and sufficient numbers of massage rollers have not been provided in order to enhance a massaging effect adequately.

Thus the conventional massaging apparatus has the massage roller mounted on the holder in a manner to be simply rotatable. Therefore, the massage roller is sometimes too strongly abutted and sometimes not adequately struck against the curved areas on the backbone of the user. Further, it has not been the practice to provide many massage rollers on one holder. For this reason, it has not been possible to adequately enhance the massaging effect.

SUMMARY OF THE INVENTION

It is accordingly the object of the present invention to provide a massaging apparatus which can massage the curved backbone surface portion of the user under a good condition.

According to one preferred embodiment of the present invention, a massaging apparatus is provided for massaging a user, comprising:

guide means having a guide section;

holding means for holding the guide means in a predetermined state;

a travelling unit so provided at the guide section of the guide means as to be freely rum;

drive means for driving the travelling unit in reciprocatory motion along the guide section;

roller supports mounted on the travelling unit; and massage rollers so rotatably mounted on the roller support as to have their rotation center oriented in a direction intersecting with the run direction of the travelling unit; wherein at least one of the roller support and massage roller is rotatably mounted on the travelling unit.

According to the above arrangement, at least one of the roller support and massage roller is rotatably mounted on the travelling unit so that the massage rollers are rotated in accordance with the uneven surface of the user's body to enhance a massaging effect.

DETAILED DESCRIPTION OF THE PREFERRED EMBODIMENTS

A first embodiment of the present invention will be explained below with reference to FIGS. 1 to 11.

Figure 1:
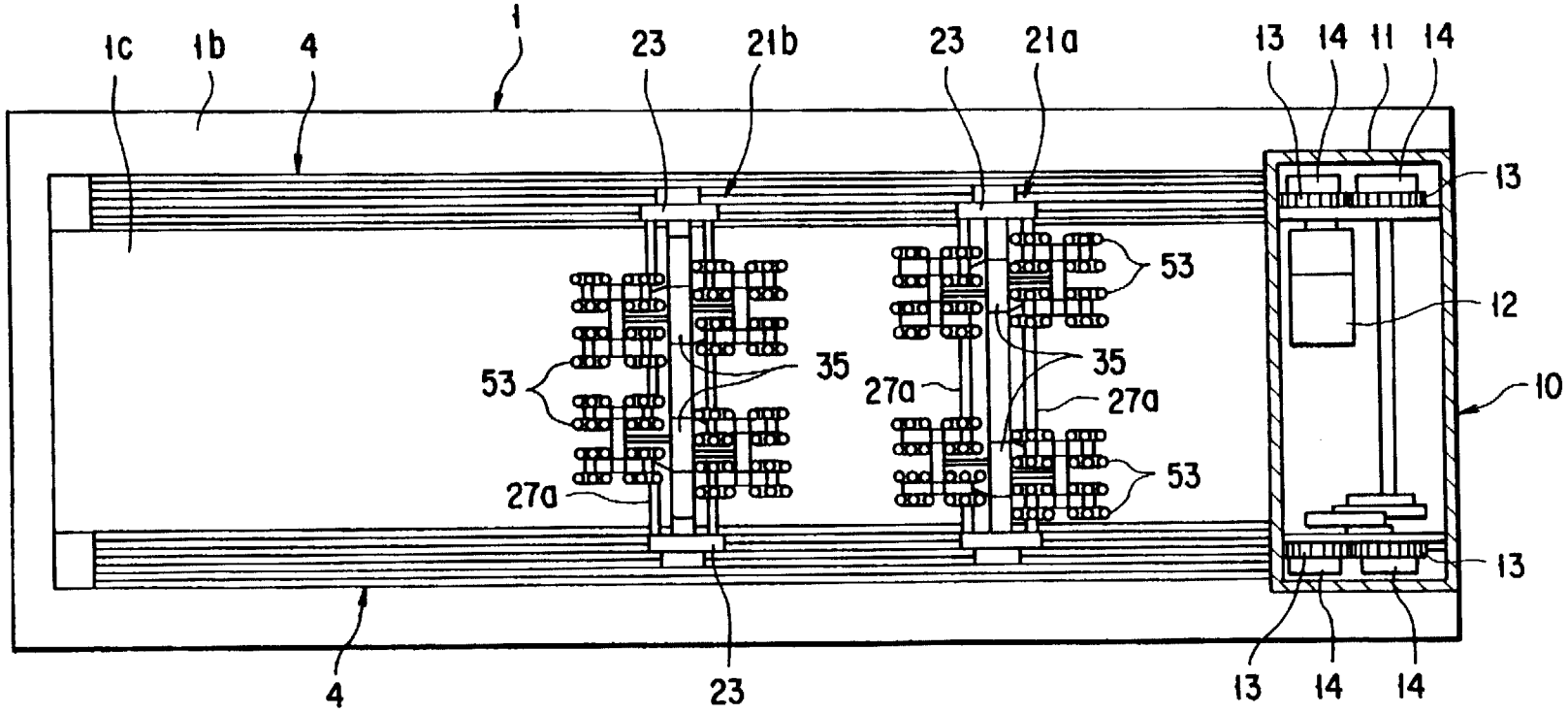
FIG. 1 is a plan view showing a whole arrangement of a first embodiment of the present invention with a cover of a base removed.
Figure 2:
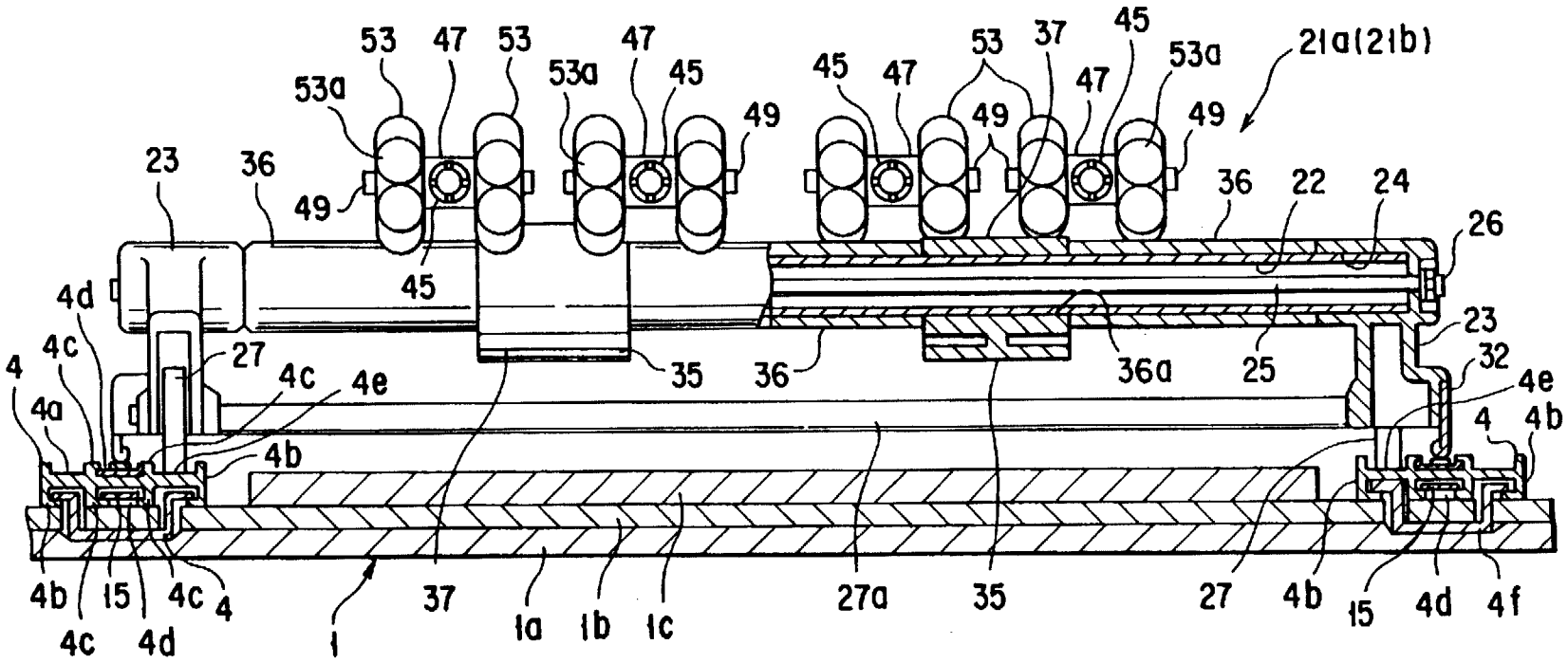
FIG. 2 is a view, partly in cross-section, showing travelling units in FIG. 1.

FIG. 1 shows a mattress type massaging apparatus of the present invention and includes a base 1 of a rectangular plate. The base 1 has a three-layered structure comprising, as shown in FIG. 2, a lower layer 1*a* formed of a relatively rigid urethane foam, etc., an intermediate layer 1*b* formed on the upper surface of the lower layer 1*a* and having a corrugated board-like configuration, and an upper layer 1*c* provided on the upper surface of the intermediate layer 1*b* and so formed of an urethane foam as to be softer than the lower layer 1*a*. The upper layer 1*c* is so formed as to have a width dimension smaller than those of the lower and intermediate layers 1*a* and 1*b*.

The base 1 having such a structure is freely bendable at the respective layers 1*a* to 1*c* and can be bent into two or three parts at the longitudinal intermediate area.

A pair of guide rails 4 are molded out of a pliable synthetic resin, such as nylon and polypropylene, and so formed, in a spaced-apart parallel relation, on the upper surface of the intermediate layer 1*b* at both width-direction end sides of the upper layer of the base 1. The guide rail 4 has a band-like base portion 4*a* as shown in in FIGS. 2, 3 and 7A and 7B and an L-shaped support section 4*b* at each width-direction end of the base portion 4*a* of the guide rail. A pair of L-shaped portions at upper and lower faces of an intermediate area of the rail base portion 4*a* are projected opposite to a pair of L-shaped portions of a similar structure to provide channels 4*d* one at the upper and lower surfaces of the rail base portion 4*a*. Further, a run face 4*e* is provided at the side portion of the upper side channel 4*d*, as will be described later, where a wheel 27 is run.

At the support sections 4*b* of the guide rail 4, both the ends of a U-shaped holding means 4*f* are engaged with the intermediate portion of the U-shaped holding means being held in the intermediate layer 1*b*. By doing so, the guide rail 4 is held in the base 1.

Figure 7A:
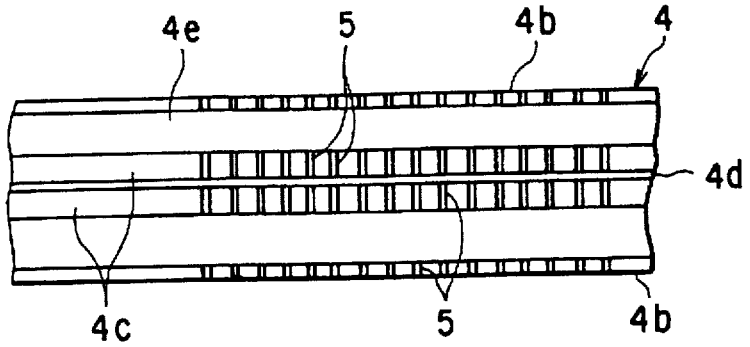
FIG. 7A is a plan view showing a guide rail in FIG. 1.
Figure 7B:
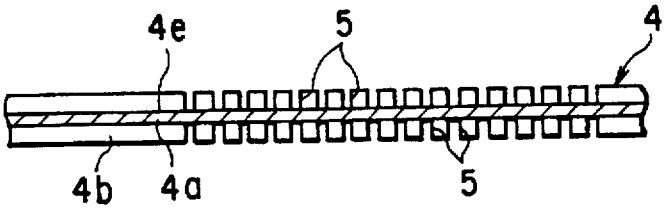
FIG. 7B is a side view showing the guide rail.

At one or two places in the intermediate area of the guide rail 4, for example, at one place in the longitudinal midportion in this embodiment, a plurality of slits 5 are formed at a given interval except at that portion of the rail portion 4*a* as shown in FIGS. 7A and 7B. For this reason, the guide rail 4 can, together with the base 1, be bent at that portion corresponding to the slits 5.

As shown in FIG. 1, a drive unit 10 is mounted on the upper surface of the base 1 at one longitudinal end portion of the base 1 and has a casing 11 where there is a drive source 12 with a motor and speed gears provided as an integral unit. The drive source 12 enables pairs of gears 13, one, provided at each side of the casing 11 to be rotated in their mutually reverse directions. The respective gear 13 has a drum 14 integral therewith.

Figure 9:
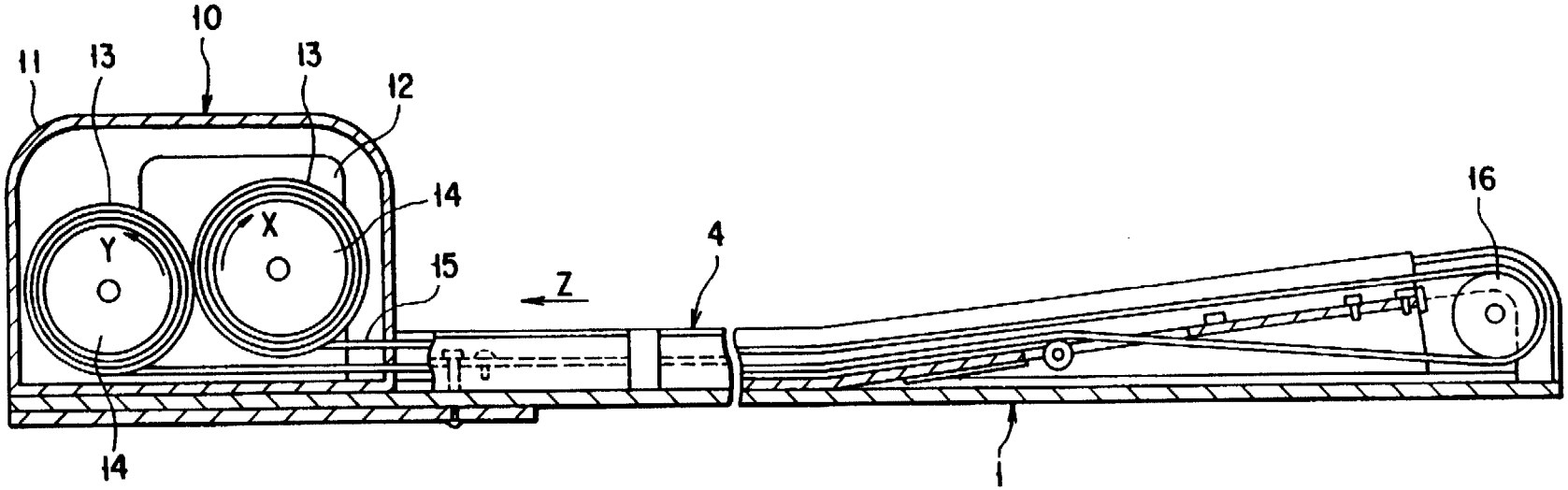
FIG. 9 is a cross-sectional view showing a base along its longitudinal direction.

As shown in FIG. 9, both the ends of a band-like belt 15 are wound on the corresponding drums 14 in a respective pair. The intermediate portion of the belt 15 is inserted in the upper and lower side channels 4*d* of the guide rail 4 and wrapped around a pulley 16 which is rotatably provided on the end of the guide rail 4.

When the respective pairs of gears 13 are rotated in the reverse directions by operating the drive source 12, then the belt 15 is delivered from the drum 14 of one gear 13 and wound around the other gear 13 whereby the belt 15 is driven along the channel 4*d*.

In FIG. 9, with the one-side drum 14 rotated in a direction of an arrow X and the other-side drum 14 rotated in the Y direction, the portion of the belt 15 passed through the upper channel 4*d* is run in a direction as indicated by an arrow Z in FIG. 9.

The belt 15 is reciprocably driven within a given run range. For example, the run distance of the belt 15 is detected with the number of rotations of the drum 14, etc., and the direction of the rotation of the gear 13 by the drive source 12 is changed with the use of the detection signal.

A first travelling unit 21*a* and second travelling unit 21*b* are provided, as shown in FIG. 1, between the paired guide rails 4. Respective travelling units 21*a*, 21*b*, each, have a hollow shaft 22 serving as a support shaft as shown in FIG. 2. Both the end portions of the hollow shaft 22 are detachably mounted in associated mount holes of a support 23. A screw shaft 25 is inserted through the hollow shaft 22. Both the end portions of the screw shaft 25 are projected outside of the supports 23 and threaded there by means of nuts 26.

Figure 3:
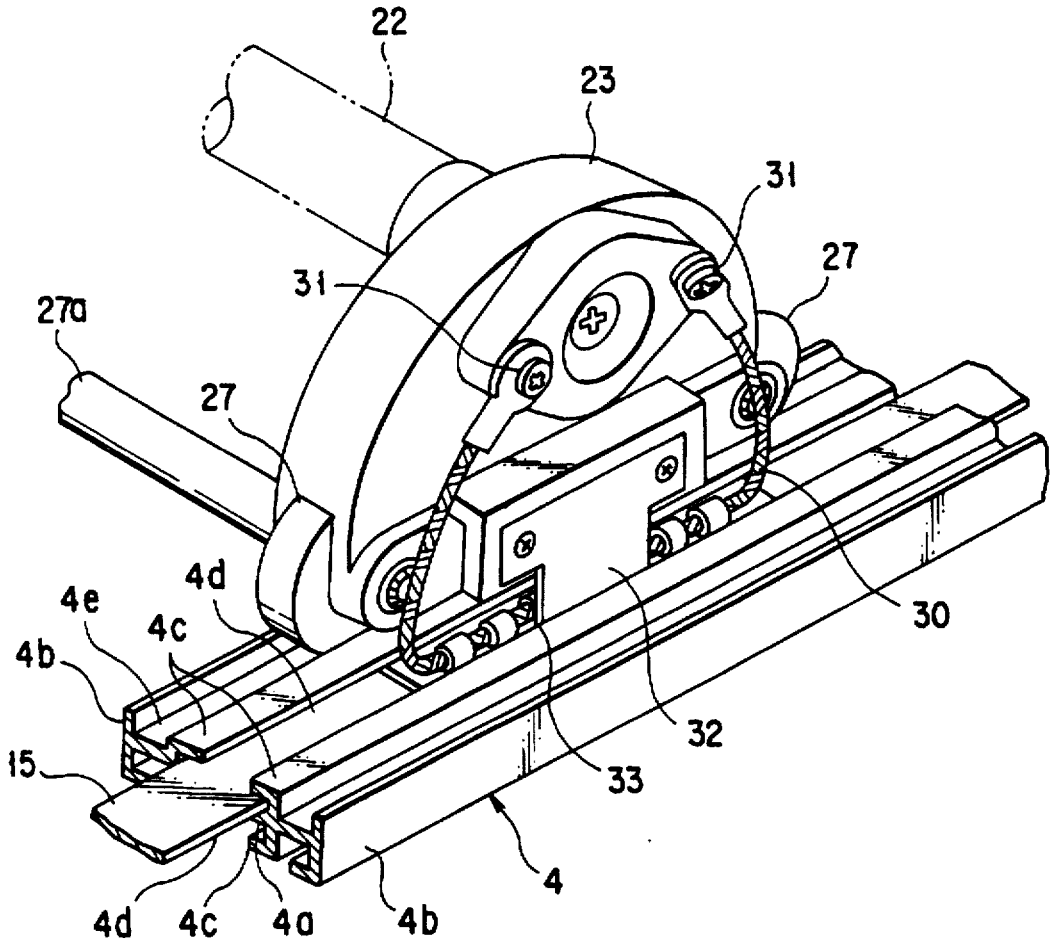
FIG. 3 is a perspective view showing a support portion of travelling unit in FIG. 1.
Figure 5:
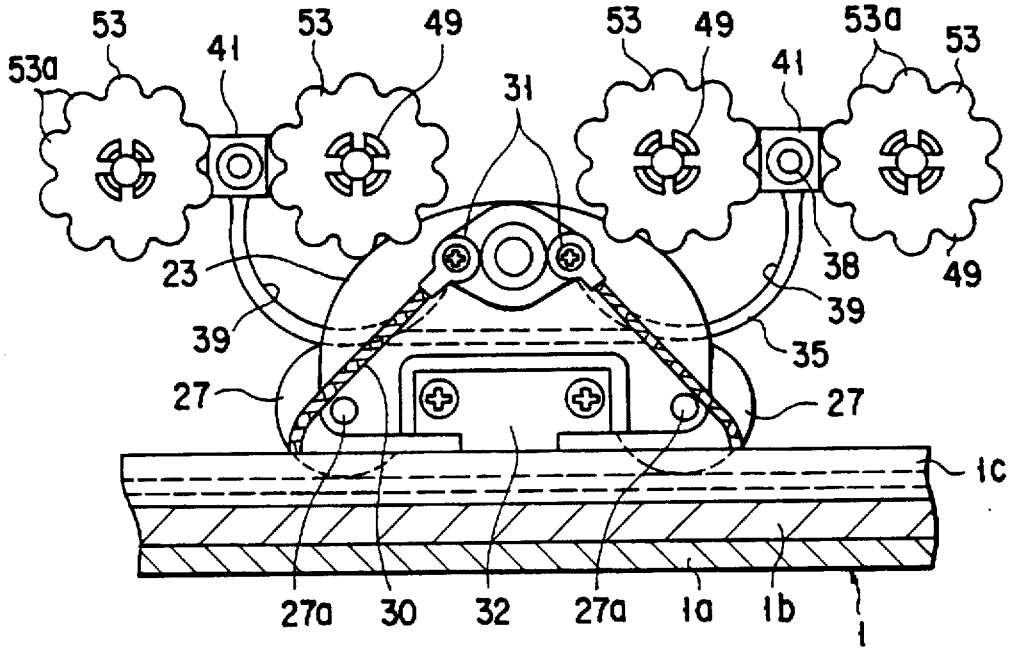
FIG. 5 is a side view showing the travelling unit in FIG. 4.

At both sides of the lowered portions of these supports 23, one pair of wheels 27 are rotatably provided by a support shaft 27*a* as shown in FIGS. 3 and 5. The wheels 27 are run along guide surfaces 4*e* of the guide rails 4 as set out above. Further, the support shafts 27*a* rotatably support the wheels 27, at their end portions, over a length defined between the paired supports 23, right and left. The right and left supports 23 are rigidly coupled by the hollow shaft 22 and paired support shafts 27*a*.

Figure 8A:
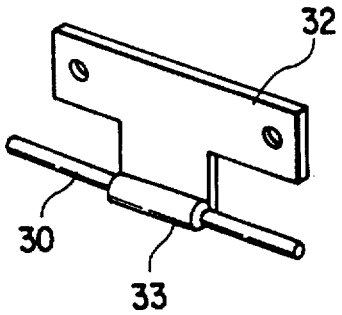
FIG. 8A is a perspective view showing a guide member mounted on the support.
Figure 8B:
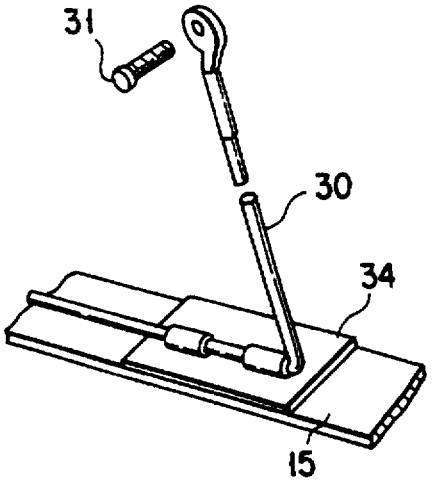
FIG. 8B is a perspective view showing a coupling structure of a mount plate and wire.

As shown in FIGS. 3, 5 and 8A, both ends of a wire 30 are fixed by screws 31 to the outer surfaces of the upper portions of the supports 23. The intermediate portion of the wire 30 is slidably inserted through a slide portion 33 of a guide member 32 provided at the intermediate portion of the lower outer surface of the support 23 and the portion of the wire 30 brought out from the slide portion 33 is coupled to a corresponding mount plate 34 which is fixed to the upper surface of the belt 15 as shown in FIG. 8B. By doing so, the wire 30 is moved in interlock with the running of the belt 15.

Figure 4:
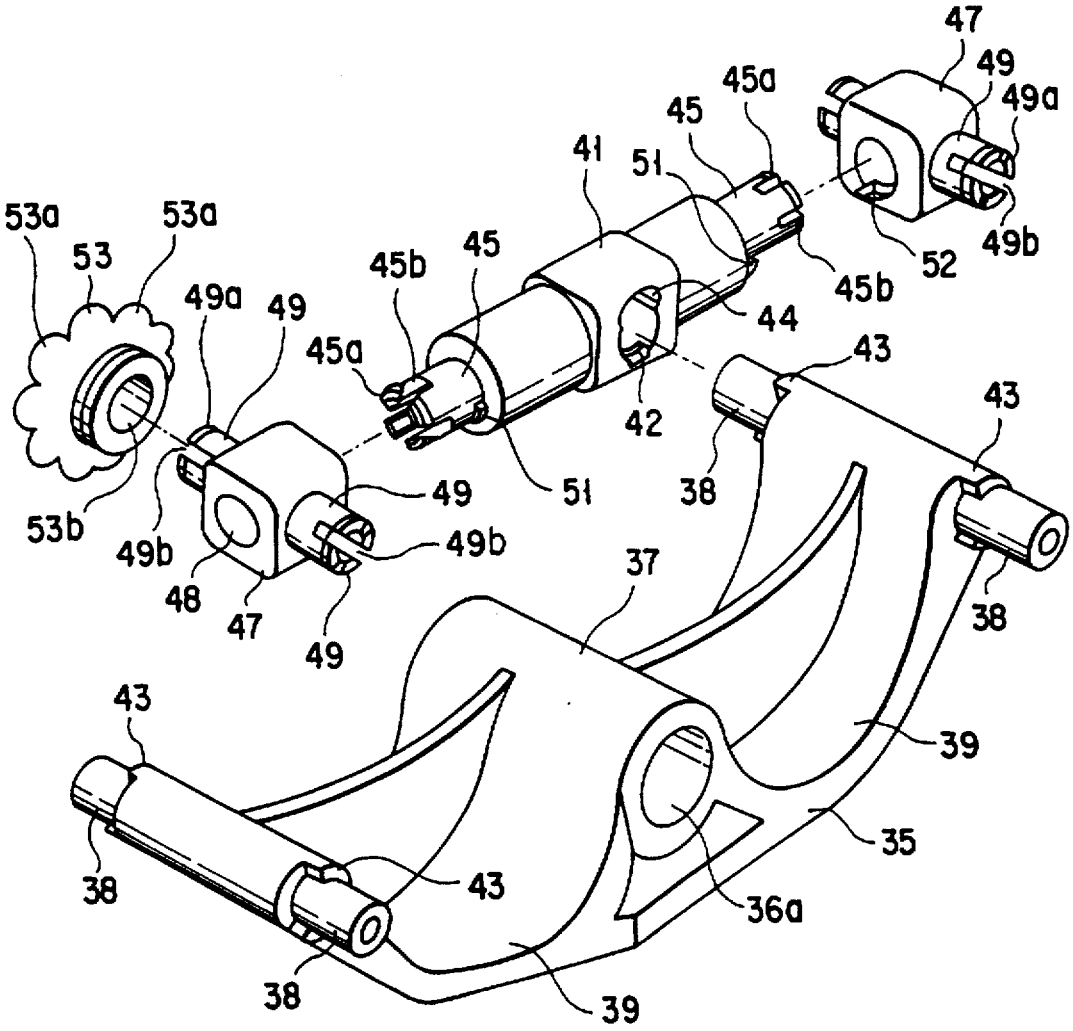
FIG. 4 is an exploded, perspective view showing a roller support in FIG. 1.

A pair of roller supports 35, each, are substantially W-shaped in a side configuration as shown in FIGS. 4 and 5 and are rotatably positioned on the hollow shafts 22 of the travelling units 21*a* and 21*b* and done so by collars 36 fitted on the hollow shafts 22. As shown in FIG. 1, the paired roller supports 35 provided on the first travelling unit 21*a* are so set as to be greater in the width-direction distance of the base 1 than the paired roller supports 35.

As shown in FIG. 4, the roller support 35 has a boss section 37, at its intermediate portion, formed around a support hole 36*a* into which the hollow shaft 22 is inserted. A first support shaft 38 is provided at a one longitudinal end side and at the other longitudinal end side of the support roller 35, that is, at both width-direction end sides of the support roller 35, with a boss section 37 as a middle. That is, four first support shafts 38 are provided on one roller support 35.

Figure 6:
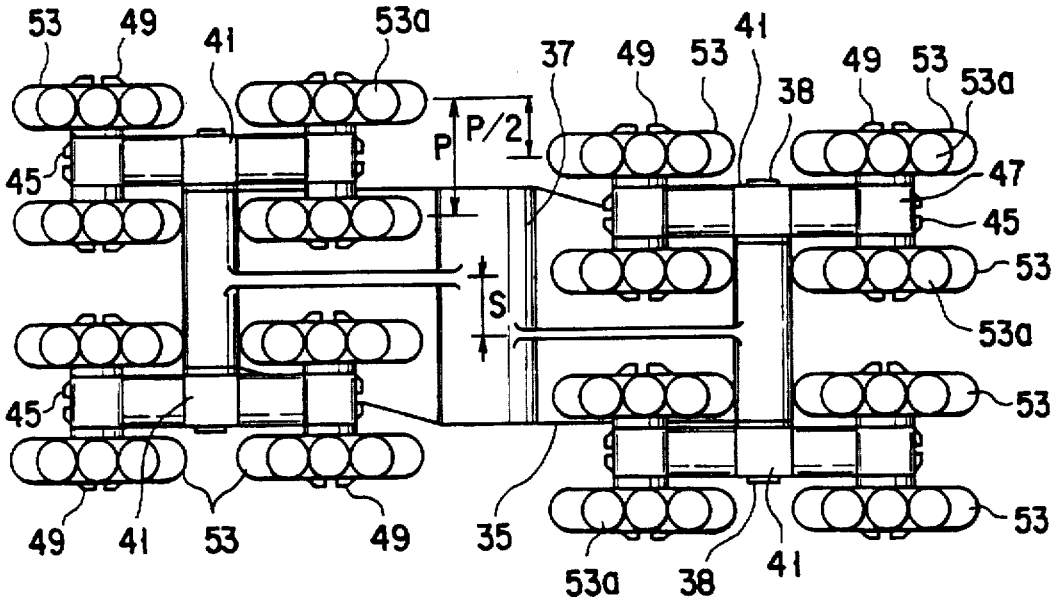
FIG. 6 is a plan view showing the travelling unit in FIG. 6.

The one-end side and other-end side of the roller support 35 with the boss section 37 as a middle are so provided as to be displaced in the width direction as indicated by a dimension S in FIG. 6. By doing so, the paired first support shafts 38 at the one longitudinal end side and paired first supports 38 at the other end side of the roller support 35 are displaced by a dimension S in the width direction.

A concavely curved surface 39 is provided between the one-side first support shaft 38 and the boss section 37 and between the other-side first support shaft 38 and the boss section 37 of the roller support 35. The support shaft 27*a* is spanned between the supports 23 in the respective travelling units 21*a* and 21*b*. The roller supports 35, being excessively rotated back and forth about the hollow shaft 22, abuts against the support shaft 27*a*, thus restricting the rotation of the roller support 35.

A roller bearing 41 is mounted over the first support shaft 38. A first mount hole 42 is provided at the axial intermediate portion of the roller bearing 41 to allow the first support shaft 38 to be freely rotated there. A first key 43 is provided partly around the outer peripheral surface of the base portion of the first support shaft 38 and a first keyway 44 is provided in the mount hole 42 to engage with the first key 43. The first key 43 is provided through an angle of 40° partly around the outer peripheral surface of the first support shaft 38 and the associated keyway 44 is provided through an angle of 130°. In consequence, the roller bearing 41 can be rotated back and forth about the first support shaft 38 through an angle of 45°.

A second support shaft 45 is provided as a hollow shaft at each axial end of the roller bearing 41 such that it extends, as a block support shaft, in a direction perpendicular to the axis of the first mount hole 42. A collar 45*a* is provided at the forward end of the second support shaft 45 and a plurality of slits 45*b* are circumferentially formed at a given interval such that these slits 45*b* are opened at the forward end portion along their axial direction. The forward end portion of the second support shaft 45 is elastically deformable in a diameter-narrowing direction.

A block 47 is provided such that its third mount hole 48 is rotatably fitted over the second support shaft 45 of each roller bearing 41. That is, the internal diameter of the third mount hole 48 is set smaller than the outer diameter of the portion of the collar 45*a* of the second support shaft 45 but somewhat greater than the outer diameter of that area other than the collar 45*a*. In consequence, with the forward end portion of the second support shaft 45 elastically deformed in the diameter-narrowing direction, the third mount hole 48 of the block 47 is fitted over the diameter-narrowed portion and, if the diameter-narrowed state is released, the block 47 is rotatably mounted and, in addition, the end face of the block 47 is set in engagement with the collar 45*a* so that the block 47 cannot be withdrawn therefrom.

A pair of roller support shafts 49 are so provided in the side faces of the respective opposed blocks 47 that each roller support shaft 49 is projected in a direction perpendicular to the axis of the third mount hole 48, that is, in a direction perpendicular to the axis of the roller bearing 41 with the roller bearing 41 so mounted. The respective roller support shaft 49 is provided as a hollow shaft with a collar 49*a* formed at its forward end portions. Further, a plurality of slits 49*b* are circumferentially provided, at a given interval, at those forward open end portions of the roller support shafts 49. The roller shafts 49 are elastically deformed by the slits 49*b* in the diameter-narrowing direction.

As shown in FIG. 4, a second key 51 is circumferentially provided, through an angle of 40°, on the outer peripheral surface of the base end portion of the respective second support shaft 45 of the roller bearing 41. A second keyway 52 is circumferentially provided, through an angle of 80°, in the end face portion of the block 47 to engage with the second key 51. Thus, the block 47 is rotatable through an angle of 40°.

As shown in FIGS. 5 and 6, massage rollers 53 are rotatably mounted on the respective roller shafts 49 as will be set out below and, each, have a plurality of circular arc-like projections 53*a* (10 projections in this embodiment). That is, 16 massage rollers 53 are provided on the respective travelling units 21*a* and 21*b* and these massage rollers 53 are mounted by the roller bearings 41, blocks 47 and roller shafts 49 so that the rollers 53 are rotatable in the back/forth and right/left directions.

Projections 53*a* of the respective rollers 53 have a substantially hemispherical shape, each, and no clearance is left between each projection and its adjacent projection.

A mount hole 53*b* is provided in the massage roller 53 and has a diameter smaller than the collar 49*a* of the roller shaft 49 but somewhat larger than an area other than the collar 49*a*. When the forward end portion of the roller shaft 49, being elastically deformed in a diameter-narrowing direction, is fitted in the mount hole 53*b* of the massage roller 53 and then the diameter-narrowed state is released, the massage roller 53 is rotatably mounted and has its end face side set in a state of engagement with the collar 49*a*, thus preventing the massage roller 53 from being withdrawn out of the collar 49*a*.

In this connection it is to be noted that, after the mounting of the first support shaft 38, the roller bearing 41 may be retained against a withdrawal by either mounting a spring (not shown) in an associated groove (not shown) provided in the forward end portion of the first support shaft 38 or providing slits and collar (these members not shown) on the first support shaft 38 as in the case of the block 48 and massage roller 53.

The first support shafts 38 one on the one end side and one on the other end side of the roller support 35 with the boss section 37 at the middle are displaced by a given dimension S in the width direction as already set out above. As a result, the massage rollers 53 are located at one end side and at the other end side of the roller support 35 in a manner to be mounted on the first support shaft 38 by the roller bearing 41 and block 47, so that the massage rollers are displayed by the dimension S as already set out above.

Here, the dimension S is set to be one-half a distance P between the paired massage rollers 53 mounted on the paired roller shafts on one block 47 as shown in FIG. 6. Thus, the eight massage rollers 53 are arranged in a four array on one end side of the roller support 35 and on the other end side of the roller support 35 in the width direction of the base 1 in such a manner to have the massage rollers 53 on the one end side displaced by P/2 relative to the massage rollers on the other end side of the massage roller in the width direction. That is, when the massage rollers 53 in the respective arrays on the roller supports 35 are driven in reciprocatory motion along the longitudinal direction of the base 1, these arranged massage rollers 53 are run in different width-direction positions.

Figure 10A:
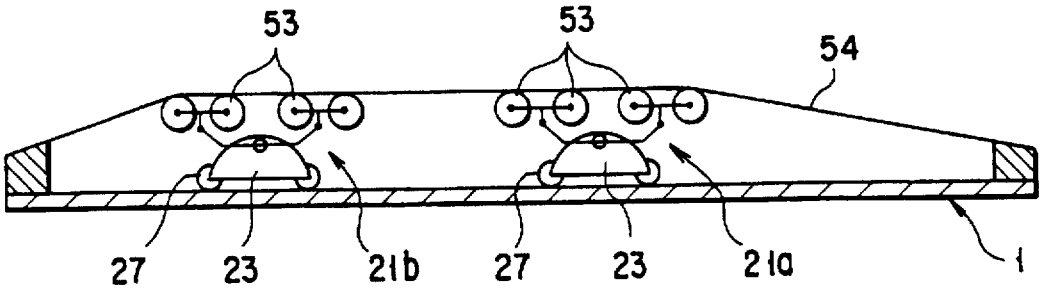
FIG. 10A is an explanative view showing the base along its longitudinal direction with massage rollers not rotated.
Figure 10B:
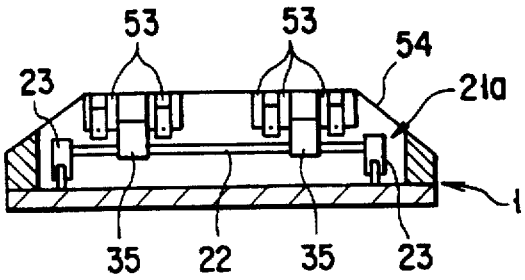
FIG. 10B is an explanative view showing the base along its width direction with the massage rollers not rotated.

The upper and lower sides of the base 1 are covered with a cover 54 made of a shrinkable cloth as shown in FIGS. 10A and 10B. A tension force is imparted to the cover 54 whereby it is set in pressure contact with the massage rollers 53 on the respective travelling units 21*a* and 21*b*, thus restricting the free rotation of the respective massage rollers 53.

As the cover 54, use may be made of a two-cover structure, not shown in more detail, comprising a protective cover made of a shrinkable cloth for restricting the rotation of the massage rollers 53 and an outer cover for covering at least one upper surface side. In this case, the protective cover has a size enough great to cover the whole upper surface side of the base 1 or is made of a band-like one to cover only the travelling units 21*a* and 21*b* and can be spread along the longitudinal direction of the base 1.

Further, the massage rollers 53 on the roller supports 35 have their back/forth and right/left direction rotations restricted by the first and second keyways and associated keys and the rotation of the roller support 35 about the hollow shaft 22 is restricted by the support shaft 27*a* spanned between the supports 23. Even if any force is exerted on the massage roller 53 via the cover 54, any excessive rotation of the massage rollers 53 is restricted.

In the massaging apparatus thus arranged, the user receives a massaging action, he or she in a supine position over the cover 54 operates the drive source 12, causing the belt 15 to be run in reciprocatory motion so that the first traveling unit 21*a* is moved, by the belt 15, in interlock with the second travelling unit 21*b*.

The first travelling unit 21*a* runs from the back to the waist of the user in reciprocatory motion and the second travelling unit 21*b* runs from the buttocks to the leg portions. The massage rollers 53 on the paired roller supports 35 provided on the first travelling unit 21*a* apply a massaging action from both the sides of the backbone to the waist portion of the user and a massage action is applied over an area from the waist to both the backs of both legs by the paired roller supports 35 on the second travelling unit 21*a* provided in a narrower distance than the paired roller supports 35.

Figure 11A:
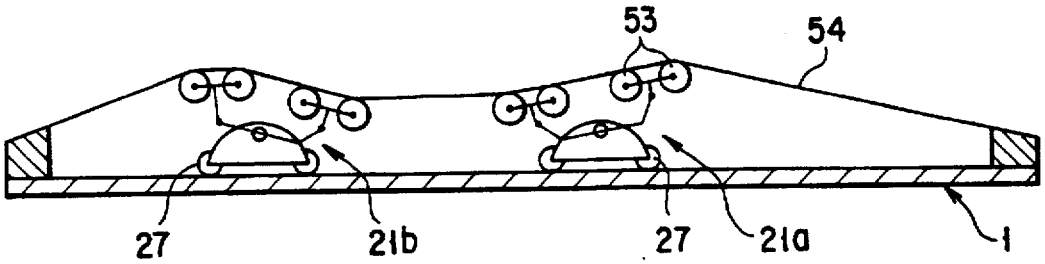
FIG. 11A is an explanative view showing the base along its longitudinal direction with the massage rollers rotated.
Figure 11B:
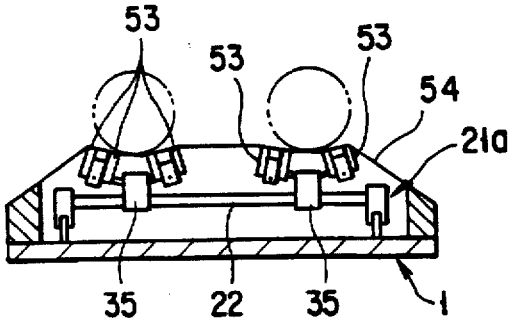
FIG. 11B is an explanative view showing the base along its width direction with the massage rollers rotated.

The massage rollers 53 are rotated through a given angle in the back/forth direction along the run direction of the respective travelling units 21*a* and 21*b* as shown in FIG. 11A and in a lateral direction intersecting with the run direction as shown in FIG. 11B. As a result, the massage rollers 53 on the respective travelling units 21*a* and 21*b* are rotated in the back/forth direction along an uneven surface of the backbone, such as the uneven surface of the waist, and along the curved-surface in the lateral direction of, for example, the buttocks and the backbone so that the user can experience a positive massage action in contact with the back surface of him or her.

The paired blocks 47 on the corresponding paired second shafts 45 provided on the roller bearing 41 are freely rotated, in a lateral direction, about the second support shaft 45.

The paired blocks 47 on the paired second support shafts 45 provided on the roller bearing 41 are freely rotated, in the lateral direction, about the second support shaft 45. That is, since the one side block 47 and other side block 47 are rotatable in a reverse direction, the degree of freedom with which the massage rollers 53 are rotated in a lateral direction is high, thus enhancing a massaging effect.

With the roller support 35 rotatable about the hollow shaft 22, the roller bearing 41 is rotatable in the back/forth direction and the massage rollers 53 are smoothly rotated in the back/forth direction, that is, rotation is effected, while responsively following any somewhat uneven surface of the back of the user, thus obtaining a better massaging effect.

The angle through which the massage rollers 53 are rotated along the width direction of the massage roller 53 is restricted through the engagement of the second keyway 52 in the block 47 with the second key 51 on the second support shaft 45 of the roller bearing 41. For this reason, the user experiences no discomfort caused by any excessive rotation of the massage rollers in the width direction and by being contacted with other than the side surface, that is, the surface other than the projection 53.

The massage rollers 53 are provided at the one run-direction end side and at the other run-direction end side of the roller supports 35 with the portion, that is, the portion supported by the hollow shaft 22, as a middle. Further, the paired first support shafts 38 are provided one at the one end side and one at the other end side of the roller support 35, the roller bearing 41 with the paired second support shafts 45 is fitted over the first support shaft 38, and the blocks 47 are provided one at each of the paired second support shafts 45 on the roller bearing 41 with the massage roller 53 mounted on each of the paired roller shafts 49.

In this arrangement, many massage rollers 53, eight massage rollers in this embodiment, are provided in four arrays at the one end side and at the other end side of the respective roller support 35. It is, therefore, possible to massage the whole "back" surface of the user by these many massage rollers 53.

Further, no clearance is left between the mutually adjacent projections 53*a* on the outer peripheral surface of the massage roller 53. When, therefore, the user is massaged with the rotating massage rollers 53, there is less chance of his or her skin portion being caught or nipped between the adjacent projections on the rollers 53 and that there is no chance that the user's skin is pulled with the rotation of the massage roller 53. Thus the user suffers no discomfort or pain during the use of the massaging apparatus.

Further, the array of the massage rollers 53 at the one end side and array of the massage rollers 53 at the other end side of the respective roller support 35 are displaced in the width direction intersecting with the run direction and, when the roller supports 35 is run, the massage rollers 53 in the respective four arrays at the one end side and massage rollers 53 in the respective four arrays at the other end side of the roller support 35 can massage the "back" surface of the user in the different width-direction position.

That is, the user experiences a massaging action in a manner as set out immediately above and receives a massaging action on the whole "back" surface portion by the many massage rollers 53 in those specific arrays.

Although, in the above-mentioned embodiment, the roller supports 35 are rotatably mounted relative to the hollow shaft 22, the roller support may be so provided as to be fixedly, that is, non-rotatably, mounted on the hollow shaft 22 with the massage rollers 53 rotatably mounted on the roller support 35 or, conversely, the roller support 35 may be so provided as to be rotatably mounted with the massage rollers 53 non-rotatably mounted on the roller support 35. That is, it is only necessary that either one of them be mounted rotatably relative to the other.

Figure 12:
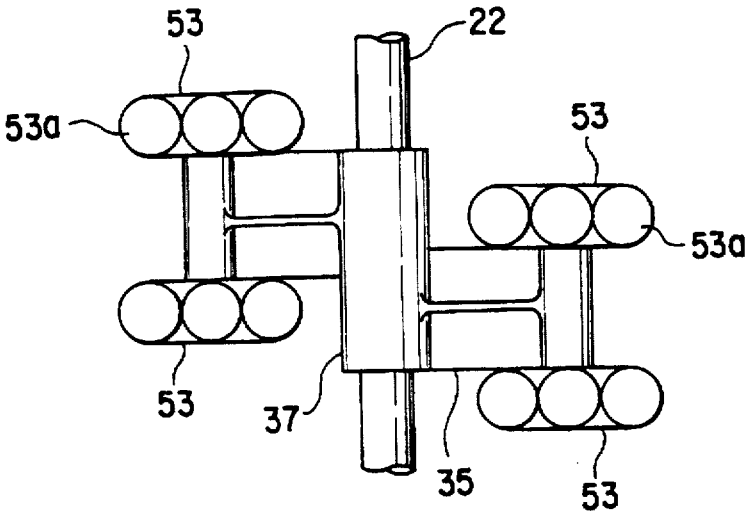
FIG. 12 is a plan view showing a variant of the roller support of the present embodiment.

Further, the massage rollers 53 may be directly and rotatably mounted on four first support shafts 38 on the roller support 35 as shown in FIG. 12. That is, the four massage rollers 53 may be so provided on one roller support 35 such that the one side massage rollers and other side massage rollers are displaced in the width direction as shown in FIG. 12.

Figure 13:
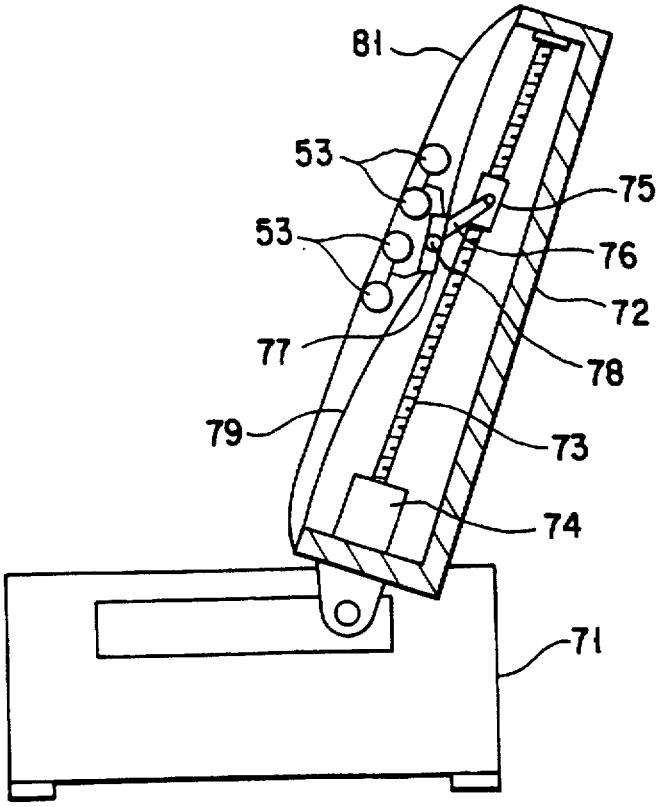
FIG. 13 is a side view showing a chair type massaging apparatus according to a second embodiment of the present invention.

FIG. 13 shows a second embodiment of the present embodiment. This embodiment is applied to a chair type massaging apparatus. Reference numeral 71 shows a seat of a chair. The lower end of a back body 72 is rotatably coupled to the rear end side of the seat 71, the back body serving as a base.

The back body 72 provides an opened box-like structure on a front face side and a screw shaft 73 is rotatably spanned in the back body in an up/down direction. The lower end of the screw shaft 73 is connected to a drive source 74 contained at the lower end side of the back body 72 and the screw shaft 73 is rotatably driven by the drive source 74.

A nut 75 is threaded over the screw shaft 73 and one end of an arm 76 is pivotally mounted on the nut 75. A roller support 77 is rotatably connected to the other end of the arm 76. Massage rollers 53 are rotatably mounted on the roller support 77 along a run direction and a direction intersecting with the run direction in the same mounting arrangement as that of the first embodiment.

With the screw shaft 73 rotated, the nut 75 is driven in an up/down direction in accordance with that rotation. The range in which the nut 75 is moved in the up/down direction is controlled by a limit switch, etc.

A guide roller 78 is rotatably mounted on each side face of the roller support 77 and rolled along guide rails 79 provided on both inner surface sides of the back body 72. The guide rails 79 is curved along the up/down direction in accordance with the "back" surface of the user. A cover 81 is spread over the front opening of the back body 72 and comprised of a shrinkable cloth 81.

In the arrangement shown, the user is seated on the chair seat, leans against the backrest, and operates the drive source 72 so that the screw shaft 73 is rotated. By doing so, the roller support 77 together with the nut 75 is moved, in up/down motion, along the screw shaft 73, thus enabling the "back" surface of the user to be massaged by the massage rollers 53 on the roller support 77. At that time, the massage rollers 53 are rotated in the run direction and in a direction intersecting with the run direction in accordance with the uneven "back" surface of the user, thus ensuring a positive massaging action against the uneven "back" surface of the user.

Figure 14:
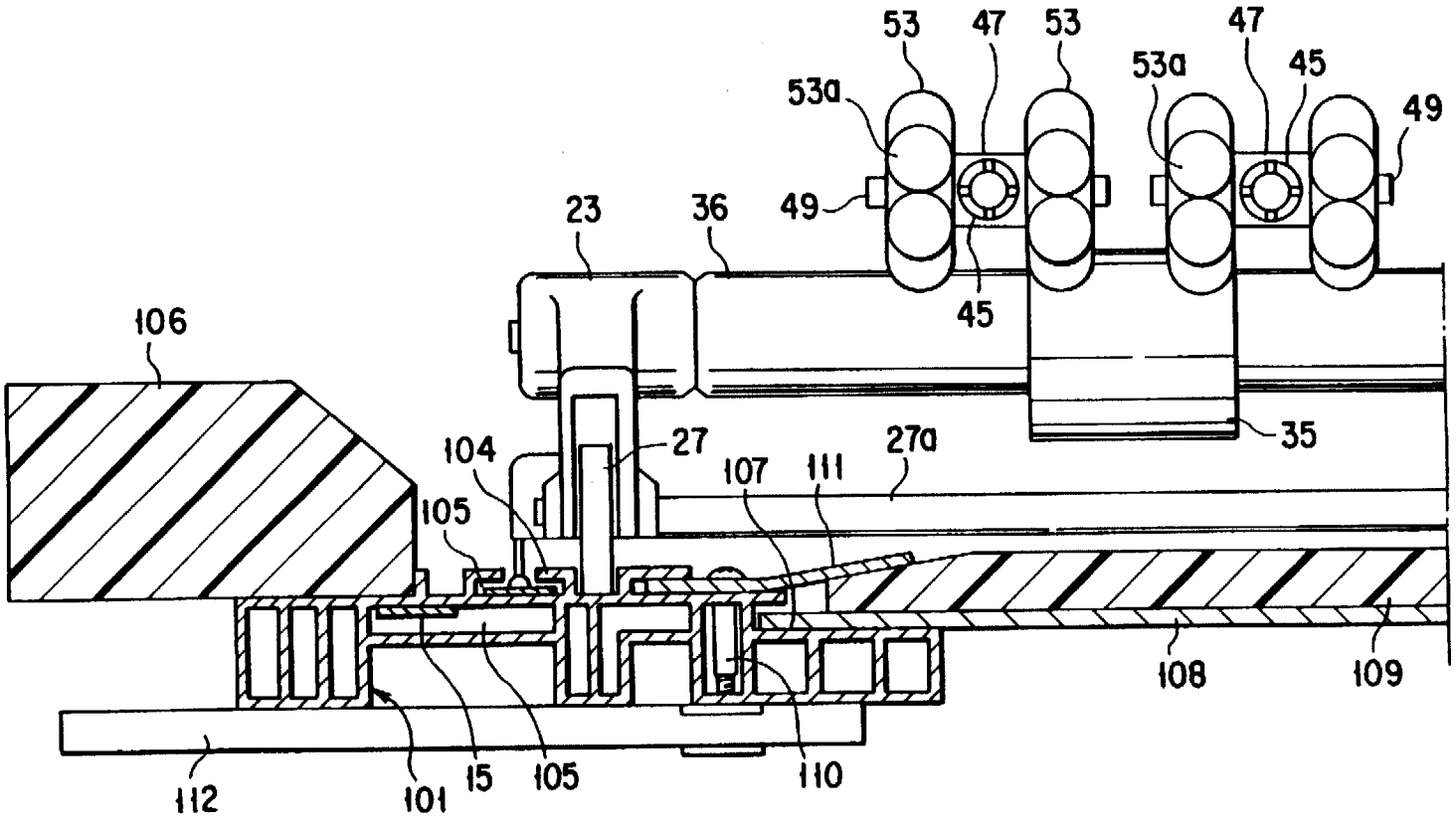
FIG. 14 is a cross-sectional view showing a base and guide rail in a third embodiment of the present invention.

FIG. 14 shows a third embodiment of the present invention and the same reference numerals are employed in this embodiment to designate parts or elements corresponding to those shown in the first embodiment.

The third embodiment shows a variant of the base and guide rails in the first embodiment. A base 101 is divided into two portions, right and left (only one is shown), and, together with guide rails 104, molded as a one-piece structure. That is, the base 101 provides a hollow structure of a given size and the guide rail 104 is integrally formed at a width-direction intermediate portion on the upper surface side of the base 101. The base 101 and guide rail 104 are made of a pliable synthetic resin, such as nylon and polypropylene. A channel 105 separated into upper and lower sides is provided at the side of the guide rail 104 and a belt 15 is inserted through the channel 105.

An outer cushioning member 106 is provided on the upper surface of a width-direction outer area of the base 101 and made of a pliable elastic material, such as urethane foam. Further, a step portion 107 is formed at the upper surface of a width-direction inner side of the base 101 and a coupling plate 108 has its width-direction end portion placed on the upper surface of the step portion 107 and is made of a pliable synthetic resin.

An inner cushioning member 109 is provided on the upper surface of the coupling plate 108 and is made of, for example, urethane foam. The width-direction end portion of the inner cushioning member 109 is held over the upper surface of the width-direction inner side of the base 101 by a band-like pressing plate 111 which is coupled by a screw 110 at its one end.

The coupling plate 108 may be provided partly relative to, or over the full length of, the base 101. Though not shown, the base 101 and guide rail 104 have slits as in the case of the first embodiment shown in FIGS. 7A and 7B so as to made them bendable. In place of these slits, the base 101 and guide rail 104 may be molded out of a bendable pliable synthetic resin.

A reinforcing plate 112 of a given size is coupled to the lower surface of the base 101. The reinforcing plate 112 is provided at an area other than the slitted area, whereby, when the base 101 is bent, no bending operation is inhibited.

We claim:

1. A massaging apparatus for massaging a user, comprising:

a pair of guide rails;

a holding unit for holding the guide rails in a parallel, spaced-apart relation;

a travelling unit having a pair of supports mounted on the guide rails to freely run thereon, and a support shaft coupling the pair of supports across the guide rails;

a drive unit for driving the travelling unit so as to have a reciprocatory motion along the guide rails in a run direction;

a roller support having a first end portion, an intermediate portion and a second end portion, said intermediate portion being rotatably mounted on the support shaft of the travelling unit; and a plurality of massage rollers rotatably mounted on the first and second end portions of the roller support along the run direction of the travelling unit.

2. The massaging apparatus according to claim 1, wherein the massage rollers mounted on the first end portion of the roller support and the massage rollers mounted on the second end portion of the roller support are displaced in a direction intersecting the run direction of the travelling unit.

3. The massaging apparatus according to claim 1, wherein the travelling unit includes a first rotation angle restricting unit for restricting a rotation angle of the roller support in a predetermined range.

4. The massaging apparatus according to claim 3, wherein the first rotation angle restricting unit comprises a pair of shaft-like members provided on opposite sides of the travelling unit along the run direction of the travelling unit.

5. The massaging apparatus according to claim 1, wherein the massage rollers are mounted the roller support so as to be rotatable along the run direction of the travelling unit.

6. The massaging apparatus according to claim 1, wherein the massage rollers are mounted on the roller support so as to be rotatable both in the run direction of the travelling unit and in a direction intersecting the run direction.

7. The massaging apparatus according to claim 1, wherein the guide rails are pliable and bendable along a longitudinal direction intermediate portion thereof.

8. The massaging apparatus according to claim 1, wherein the guide rail are pliable and bendable along a longitudinal direction intermediate portion thereof, and the holding unit is also pliable and bendable together with the guide rails.

9. The massaging apparatus according to claim 1, wherein the roller support comprises:

first support shafts respectively mounted at the first and second end portions of the roller support, said first support shafts each having an axis substantially parallel to the support shaft of the travelling unit;

roller bearings respectively rotatably mounted on the first support shafts, said roller bearings each having a second support shaft and each having an axis in a same direction as a rotation direction of the roller support; and a plurality of blocks each having a roller support shaft and each being supported on respective ones of the second support shafts so as to be rotatable with axes of the respective roller support shafts intersecting the rotation direction of the roller support; and wherein the massage rollers are rotatably mounted on the roller support shafts.

10. The massaging apparatus according to claim 9, further comprising second rotation angle restricting units provided on the roller bearings and partly around the first support shafts to restrict a rotation angle of the roller bearings.

11. The massaging apparatus according to claim 10, wherein the second rotation angle restricting units comprise a key provided through a predetermined angle partly around the first support shafts and a keyway provided in the roller bearings along a circumferential direction through an angle greater than that of the key.

12. The massaging apparatus according to claim 10, wherein said second rotation angle restricting units are provided on the second support shafts and in the blocks to restrict a rotation angle of the blocks.

13. The massaging apparatus according to claim 12, wherein the second rotation angle restricting units comprise a key provided through a predetermined angle in the second support shafts and a keyway provided in an inner circumferential area of the blocks through an angle greater than that of the key.

* * * * *